US006732522B2

(12) United States Patent
Wright et al.

(10) Patent No.: US 6,732,522 B2
(45) Date of Patent: May 11, 2004

(54) SYSTEM FOR ESTIMATING ENGINE EXHAUST PRESSURE

(75) Inventors: John F. Wright, Columbus, IN (US); Daniel E. Boewe, Columbus, IN (US)

(73) Assignee: Cummins, Inc., Columbus, IN (US)

( * ) Notice: Subject to any disclaimer, the term of this patent is extended or adjusted under 35 U.S.C. 154(b) by 110 days.

(21) Appl. No.: 10/117,881

(22) Filed: Apr. 8, 2002

(65) Prior Publication Data

US 2003/0188531 A1 Oct. 9, 2003

(51) Int. Cl.[7] ..... F02D 23/00

(52) U.S. Cl. ..... 60/602; 60/605.2; 123/559.1; 123/568.21

(58) Field of Search ..... 60/602, 605.1, 60/605.2, 611; 123/559.1, 568.21

(56) References Cited

U.S. PATENT DOCUMENTS 4,690,120 A * 9/1987 Egle ..... 123/568.16
4,823,798 A * 4/1989 Ichikawa ..... 123/568.16
5,186,005 A * 2/1993 Yoshioka et al. ..... 60/600
5,753,805 A 5/1998 Maloney
6,026,790 A 2/2000 Itoyama
6,035,639 A 3/2000 Kolmanovsky et al.
6,161,384 A * 12/2000 Reinbold et al. ..... 60/602
6,178,749 B1 1/2001 Kolmanovsky et al.
6,182,644 B1 2/2001 Kotwicki et al.
6,308,694 B1 10/2001 Kotwicki et al.
6,321,732 B1 11/2001 Kotwicki et al.
6,497,227 B2 * 12/2002 Wang et al. ..... 123/568.16

* cited by examiner

*Primary Examiner*—Hoang Nguyen
(74) *Attorney, Agent, or Firm*—Barnes & Thornburg

(57) ABSTRACT

A system for estimating engine exhaust pressure includes a pressure sensor fluidly coupled to an intake manifold of the engine, a turbocharger having a turbine fluidly coupled to an exhaust manifold of the engine, a control actuator responsive to a control command to control either of a swallowing capacity and a swallowing efficiency of the turbine, and a control computer estimating engine exhaust pressure as a function of the pressure signal and the control command. In an alternate embodiment, the system includes an engine speed sensor, an EGR valve fluidly connected between the intake manifold and the exhaust manifold, and an EGR valve position sensor. The control computer is operable in this embodiment to estimate engine exhaust pressure as a function of the pressure signal, the control command, the engine speed signal and the EGR valve position signal.

40 Claims, 5 Drawing Sheets

SYSTEM FOR ESTIMATING ENGINE EXHAUST PRESSURE

FIELD OF THE INVENTION

The present invention relates generally to systems for determining the pressure of exhaust gas produced by an internal combustion engine, and more specifically to such systems for estimating engine exhaust pressure as a function of one or more engine operating parameters.

BACKGROUND AND SUMMARY OF THE INVENTION

When combustion occurs in an environment with excess oxygen, peak combustion temperatures increase which leads to the formation of unwanted emissions, such as oxides of nitrogen ($NO_x$). This problem is aggravated through the use of turbocharger machinery operable to increase the mass of fresh air flow, and hence increase the concentrations of oxygen and nitrogen present in the combustion chamber when temperatures are high during or after the combustion event.

One known technique for reducing unwanted emissions such as $NO_x$ involves introducing chemically inert gases into the fresh air flow stream for subsequent combustion. By thusly reducing the oxygen concentration of the resulting charge to be combusted, the fuel burns slower and peak combustion temperatures are accordingly reduced, thereby lowering the production of $NO_x$. In an internal combustion engine environment, such chemically inert gases are readily abundant in the form of exhaust gases, and one known method for achieving the foregoing result is through the use of a so-called Exhaust Gas Recirculation (EGR) system operable to controllably introduce (i.e., recirculate) exhaust gas from the exhaust manifold into the fresh air stream flowing to the intake manifold valve, for controllably introducing exhaust gas to the intake manifold. Through the use of an on-board microprocessor, control of the EGR valve is typically accomplished as a function of information supplied by a number of engine operational sensors.

While EGR systems of the foregoing type are generally effective in reducing unwanted emissions resulting from the combustion process, a penalty is paid thereby in the form of a resulting loss in engine efficiency. A tradeoff thus exists in typical engine control strategies between the level of $NO_x$ production and engine operating efficiency, and difficulties associated with managing this tradeoff have been greatly exacerbated by the increasingly stringent requirements of government-mandated emission standards.

In order to achieve the dual, yet diametrically opposed, goals of limiting the production of $NO_x$ emissions to acceptably low levels while also maximizing engine operational efficiency under a variety of load conditions, substantial effort must be devoted to determining with a high degree of accuracy the correct proportions of air, fuel and exhaust gas making up the combustion charge. To this end, accurate, real-time values of a number of EGR system-related operating parameters must therefore be obtained, preferably at low cost. Control strategies must then be developed to make use of such information in accurately controlling the engine, EGR system and/or turbocharger. The present invention is directed to techniques for determining some of these parameters.

In accordance with one aspect of the present invention, a system and method are provided for estimating engine exhaust pressure as a function of other engine operating conditions. In one embodiment, the engine exhaust pressure estimate may be used by itself to supply engine exhaust pressure information to one or more control strategies. In another embodiment, the engine exhaust pressure estimate may be used to validate and/or diagnose the operation of a physical exhaust pressure sensor.

In accordance with another aspect of the present invention, a system and method are provided for estimating intake air pressure as a function of other engine operating conditions. In one embodiment, the intake air pressure estimate may be used by itself to supply intake air pressure information to one or more control strategies. In another embodiment, the intake air pressure estimate may be used to validate and/or diagnose the operation of a physical intake air pressure sensor.

These and other objects of the present invention will become more apparent from the following description of the preferred embodiments.

DESCRIPTION OF THE PREFERRED EMBODIMENTS

Figure 1:
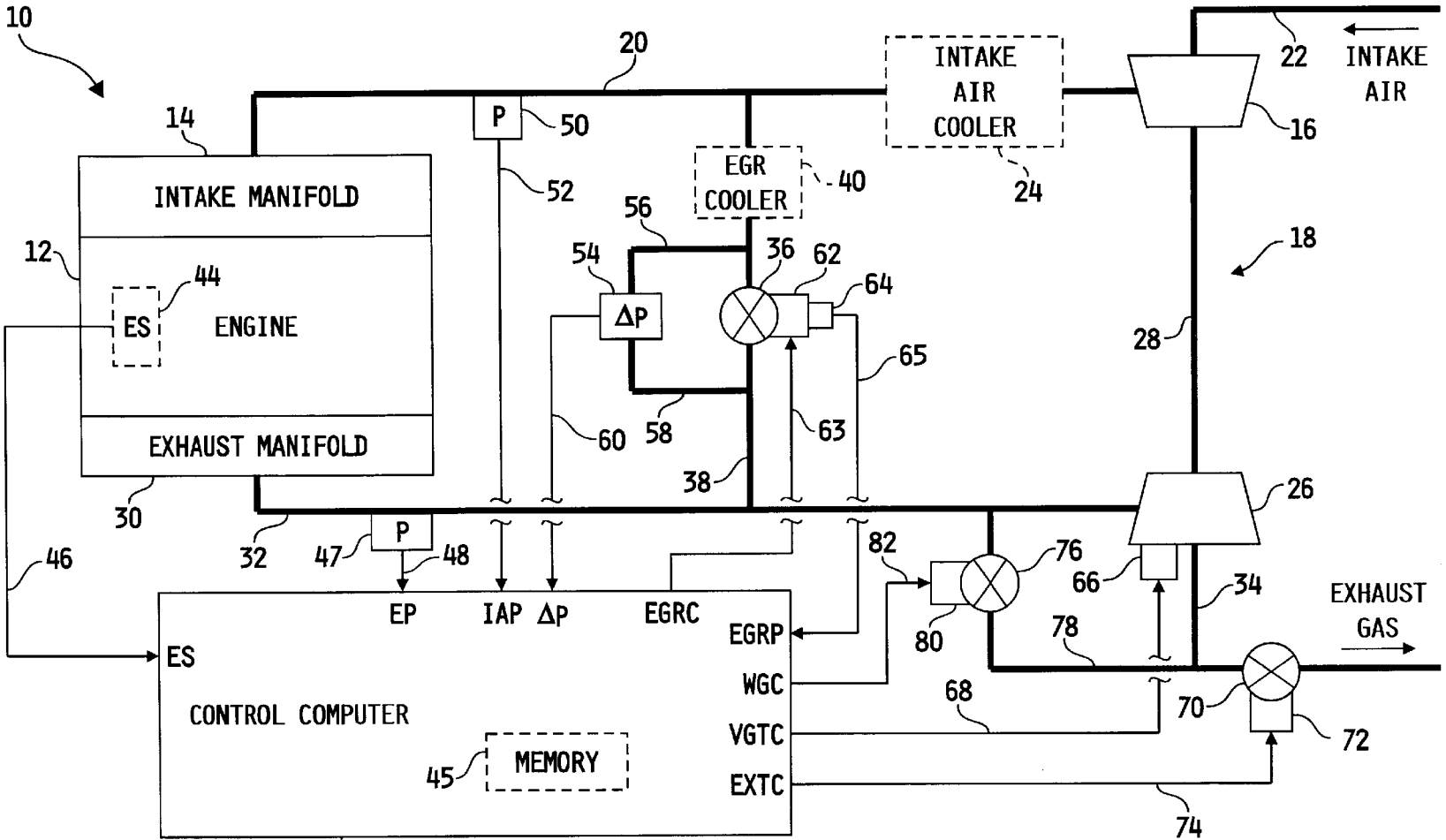
FIG. 1 is a diagrammatic illustration of one preferred embodiment of a system for estimating engine exhaust and/or intake air pressure, in accordance with the present invention.

For the purposes of promoting an understanding of the principles of the invention, reference will now be made to a number of preferred embodiments illustrated in the drawings and specific language will be used to describe the same. It will nevertheless be understood that no limitation of the scope of the invention is thereby intended, such alterations and further modifications in the illustrated embodiments, and such further applications of the principles of the invention as illustrated therein being contemplated as would normally occur to one skilled in the art to which the invention relates.

Referring now to FIG. 1, a diagrammatic illustration of one preferred embodiment of a system 10 for estimating engine exhaust and/or intake air pressure, in accordance with the present invention, is shown. System 10 includes an internal combustion engine 12 having an intake manifold 14 fluidly coupled to an outlet of a compressor 16 of a turbocharger 18 via an intake conduit 20, wherein the compressor 16 includes a compressor inlet coupled to an intake conduit 22 for receiving fresh air therefrom. Optionally, as shown in phantom in FIG. 1, system 10 may include an intake air cooler 24 of known construction disposed in line with intake conduit 20 between the turbocharger compressor 16 and the intake manifold 14. The turbocharger compressor 16 is mechanically coupled to a turbocharger turbine 26 via a drive shaft 28, wherein turbine 26 includes a turbine inlet fluidly coupled to an exhaust manifold 30 of engine 12 via an exhaust conduit 32, and further includes a turbine outlet fluidly coupled to ambient via an exhaust conduit 34. An EGR valve 36 is disposed in-line with an EGR conduit 38 disposed in fluid communication with the intake conduit 20 and the exhaust conduit 32, and an EGR cooler 40 of known construction may optionally be disposed in-line with EGR conduit 38 between EGR valve 36 and intake conduit 20 as shown in phantom in FIG. 1.

System 10 includes a control controller 42 that is preferably microprocessor-based and is generally operable to control and manage the overall operation of engine 12. Control computer 42 includes a memory unit 45 as well as a number of inputs and outputs for interfacing with various sensors and systems coupled to engine 12. Control computer 42, in one embodiment, may be a known control unit sometimes referred to as an electronic or engine control module (ECM), electronic or engine control unit (ECU) or the like, or may alternatively be a control circuit capable of operation as will be described hereinafter. In any case, control computer 42 preferably includes one or more control algorithms, as will be described in greater detail hereinafter, for accommodating sensor failures based on input signals provided by a number of actual sensors.

Control computer 42 includes a number of inputs for receiving signals from various sensors or sensing systems associated with system 10. For example, system 10 includes an engine speed sensor 44 electrically connected to an engine speed input, ES, of control computer 42 via signal path 46. Engine speed sensor 44 is operable to sense rotational speed of the engine 12 and produce an engine speed signal on signal path 46 indicative of engine rotational speed. In one embodiment, sensor 44 is a Hall effect sensor operable to determine engine speed by sensing passage thereby of a number of equi-angularly spaced teeth formed on a gear or tone wheel. Alternatively, engine speed sensor 44 may be any other known sensor operable as just described including, but not limited to, a variable reluctance sensor or the like.

System 10 further includes a pressure sensor 47 disposed in fluid communication with exhaust conduit 32 and electrically connected to an engine exhaust pressure input (EP) of control computer 42 via signal path 48. Alternatively, pressure sensor 47 may be disposed in fluid communication with exhaust manifold 30. In either case, pressure sensor 47 may be of known construction and is operable to produce a pressure signal on signal path 48 indicative of engine exhaust pressure within exhaust manifold 30 and exhaust conduit 32.

System 10 further includes a pressure sensor 50 disposed in fluid communication with intake conduit 20 and electrically connected to an intake air pressure input (IAP) of control computer 42 via signal path 52. Alternatively, pressure sensor 50 may be disposed in fluid communication with the intake manifold 14. In any case, pressure sensor 50 may be of known construction, and is operable to produce a pressure signal on signal path 52 indicative of intake air pressure within intake conduit 20 and intake manifold 14. Pressure sensor 50 may sometimes referred to in the art as a so-called "boost pressure" sensor because it is operable to sense changes in pressure (i.e., "boost" pressure) within conduit 20 and intake manifold 14 resulting from the operation of the turbocharger 18. Alternatively, pressure sensor 50 may sometimes be referred to in the art as an intake manifold pressure sensor, or compressor outlet pressure sensor, and for purposes of the present invention, the terms "intake air pressure", "boost pressure", "intake manifold pressure" and "compressor outlet pressure" are considered to by synonymous.

System 10 further includes a differential pressure sensor, or ΔP sensor, 54 fluidly coupled at one end to EGR conduit 38 via conduit 56 and at an opposite end to EGR conduit 38 via conduit 58. Alternatively, the ΔP sensor 62 may be coupled across another flow restriction mechanism disposed in-line with EGR conduit 38. In either case, the ΔP sensor 54 may be of known construction and is electrically connected to a ΔP input of control computer 42 via signal path 60. The ΔP sensor 54 is operable to provide a differential pressure signal on signal path 60 indicative of the pressure differential across EGR valve 36 or other flow restriction mechanism disposed in-line with EGR conduit 38.

Control computer 42 also includes a number of outputs for controlling one or more air handling mechanisms associated with system 10. For example, EGR valve 36 includes an EGR valve actuator 62 electrically connected to an EGR valve control output (EGRC) of control computer 42 via signal path 63. Control computer 42 is operable in a known manner to produce an EGR valve control signal on signal path 63, and EGR valve actuator 62 is responsive to the EGR valve control signal on signal path 63 to control the position of EGR valve 36 relative to a reference position. EGR valve 36 further includes an EGR valve position sensor 64 of known construction and electrically connected to an EGR valve position input, EGRP, of control computer 42 via signal path 65. Sensor 64 is operable to produce a position signal on signal path 65 indicative of the position of the EGR valve actuator 62 relative to a reference position. Control computer 42 is operable to process the EGR valve position signal on signal path 65 and determine therefrom a position of EGR valve 36 relative to a reference position.

Engine controller 42 also includes at least one output for controlling turbocharger swallowing capacity and/or efficiency, wherein the term "turbocharger swallowing capacity" is defined for purposes of the present invention as the exhaust gas flow capacity of the turbocharger turbine 26, and the term "turbocharger swallowing efficiency" refers to the ability of the turbocharger turbine 26 to process the flow of exhaust gas exiting the exhaust manifold 30. In general, the swallowing capacity and/or efficiency of the turbocharger 18 directly affects a number of engine operating conditions including, for example, but not limited to, compressor outlet pressure, turbocharger rotational speed and exhaust pressure; i.e., the pressure of exhaust gas within exhaust manifold and exhaust conduit 32, and exemplary embodiments of some turbocharger swallowing capacity/efficiency control mechanisms are illustrated in FIG. 1. For example, one turbocharger swallowing capacity control mechanism that may be included within system 10 is a known electronically controllable variable geometry turbocharger turbine 26. In this regard, turbine 26 includes a variable geometry actuator 66 electrically connected to a variable geometry turbocharger control output (VGTC) of control computer 42 via signal path 68. Control computer 42, in one embodiment, is operable to produce a variable geometry turbocharger control signal on signal path 68, and variable geometry turbocharger actuator 66 is responsive to this control signal to control the swallowing capacity (i.e., exhaust gas flow capacity) of turbine 26 by controlling the flow geometry of turbine 26 in a known manner.

Another turbocharger swallowing capacity control mechanism that may be included within system 10 is a known electronically controllable exhaust throttle 70 having an exhaust throttle actuator 72 electrically connected to an exhaust throttle control output (EXTC) of control computer 42 via signal path 74. In one embodiment, exhaust throttle 70 is disposed in-line with exhaust conduit 34 as illustrated in FIG. 1, although the present invention contemplates that exhaust throttle 70 may alternatively be disposed in-line with exhaust conduit 32. Control computer 42, in one embodiment, is operable to produce an exhaust throttle control signal on signal path 74, and exhaust throttle actuator 72 is responsive to this control signal to control the position of exhaust throttle 70 relative to a reference position. The position of exhaust throttle 70 defines a cross-sectional flow area therethrough, and by controlling the cross-sectional flow area of the exhaust throttle 70, control computer 42 is operable to control the flow rate of exhaust gas produced by engine 12, and thus the swallowing capacity (i.e., exhaust gas flow capacity) of turbine 26.

One turbocharger swallowing efficiency control mechanism that may be included within system 10 is a known electronically controllable wastegate valve 76 having a wastegate valve actuator 80 electrically connected to a wastegate valve control output (WGC) of control computer 42 via signal path 82. Wastegate valve 76 has an inlet fluidly coupled to exhaust conduit 32, and an outlet fluidly coupled to exhaust conduit 34 via conduit 78. In embodiments of system 10 including both a wastegate valve 76 and an exhaust throttle 70, the outlet of wastegate valve 76 may be fluidly coupled to exhaust conduit 34 upstream of exhaust throttle 70 as shown in FIG. 1, or may alternatively be coupled to exhaust conduit 34 downstream of exhaust throttle 70. In either case, control computer 42, in one embodiment, is operable to produce a wastegate valve control signal on signal path 82, and wastegate valve actuator 80 is responsive to this control signal to control the position of wastegate valve 80 relative to a reference position. The position of wastegate valve 80 defines a cross-sectional flow area therethrough, and by controlling the cross-sectional flow area of the wastegate valve 80, control computer 42 is operable to selectively divert exhaust gas away from turbine 26, and thereby control the swallowing efficiency of turbine 26.

It is to be understood that while FIG. 1 is illustrated as including all of the foregoing turbocharger swallowing capacity/efficiency control mechanisms (i.e., variable geometry turbine 26, exhaust throttle 70 and wastegate valve 76), the present invention contemplates embodiments of system 10 that include any single one, or any combination, of such control mechanisms. Additionally, control computer 42 may be configured to control any one or combination of such control mechanisms to thereby control turbocharger swallowing capacity and/or efficiency in a known manner.

In one embodiment, the engine exhaust pressure, EP; i.e., the pressure of exhaust gas within the exhaust manifold 30 and exhaust conduit 32, can be accurately estimated as the sum of the intake air pressure signal, IAP, and the differential pressure value, ΔP; e.g., EP=IAP+ΔP. In accordance with one aspect of the present invention, engine exhaust pressure, EP, may alternatively or additionally be estimated as a function of the intake air pressure signal, IAP, provided by sensor 50 and one or more of the turbocharger swallowing capacity/efficiency control mechanism commands; e.g., VGTC, EXTC and/or WGC. In accordance with another aspect of the present invention, engine exhaust pressure, EP, may be estimated as a function of the intake air pressure signal, IAP, provided by sensor 50, one or more of the turbocharger swallowing capacity/efficiency control mechanism commands; e.g., VGTC, EXTC and/or WGC, the engine speed signal, ES, provided by sensor 44 and the EGR valve position signal, EGRP, provided by sensor 64. In either case, such an estimation may be useful, by itself, in providing exhaust pressure information to one or more control algorithms executed by control computer 42 and/or other processor in communication therewith. Such an estimation may alternatively or additionally be useful in providing redundant and/or backup exhaust pressure information. Such an estimation may further be useful in diagnosing fault and/or failure conditions related to the engine exhaust pressure sensor 46 and/or ΔP sensor 54, and/or used in systems wherein the ΔP information is unreliable or unavailable.

Figure 2:
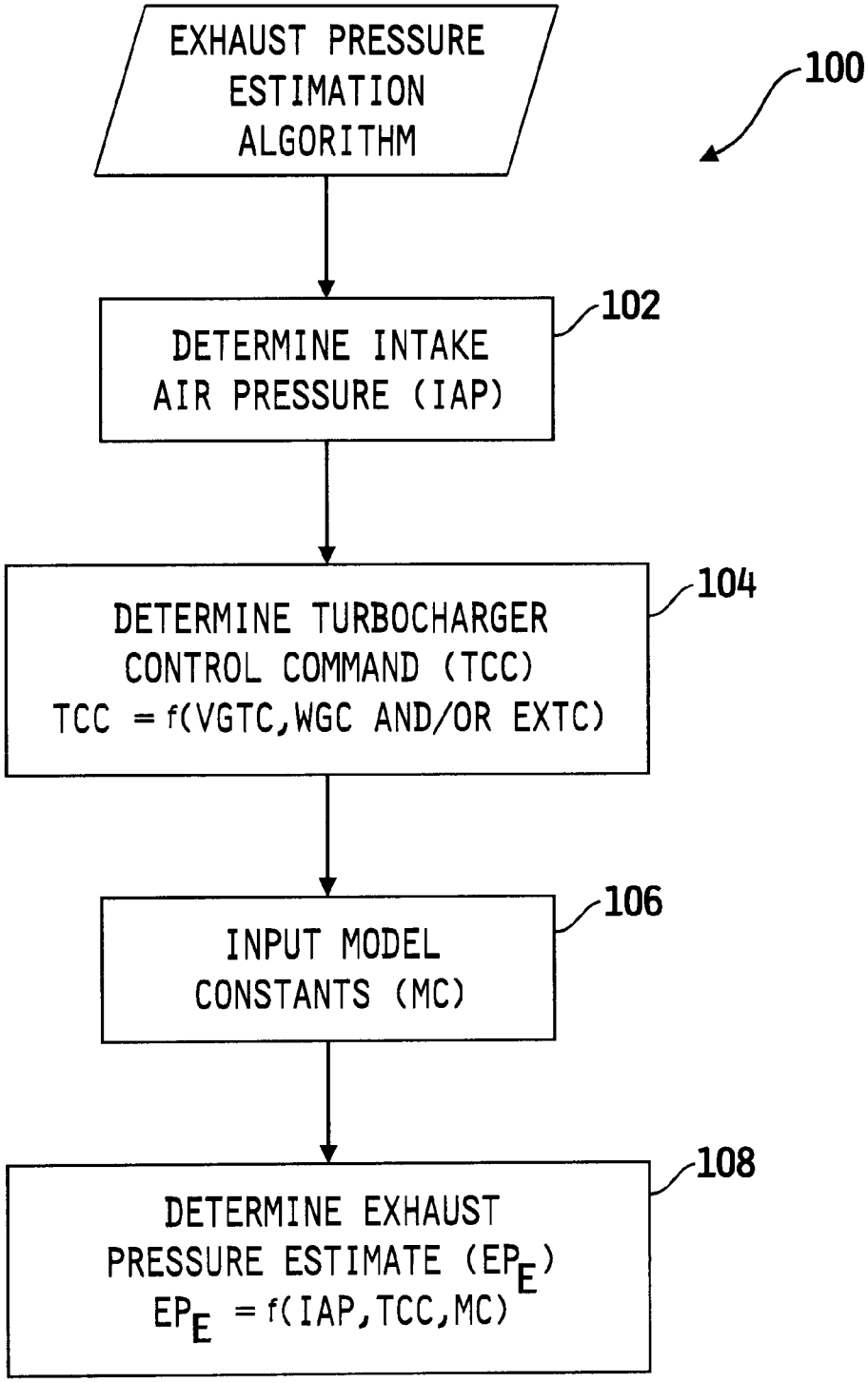
FIG. 2 is a flowchart illustrating one preferred embodiment of a software algorithm for estimating engine exhaust pressure, in accordance with the present invention.

Referring now to FIG. 2, a flowchart is shown illustrating one preferred embodiment of a software algorithm 100 for estimating engine exhaust pressure, in accordance with the present invention. Algorithm 100 is preferably stored within memory 45, and is executed by control computer 42. Algorithm 100 begins at step 102 where control computer 42 is operable to determine intake air pressure, IAP, corresponding to the pressure of air within the intake conduit 20 and intake manifold 14. In one embodiment, control computer 42 is operable to determine IAP directly from sensor 50, although the present invention contemplates that control computer 42 may alternatively or additionally include one or more known software algorithms for estimating IAP as a function of one or more engine operating conditions other than engine exhaust pressure. An example of one such intake air pressure estimation algorithm is described in co-pending U.S. Patent Application Publication No. US2003/0177765 A1, entitled SYSTEM FOR ESTIMATING ABSOLUTE BOOST PRESSURE IN A TURBOCHARGED INTERNAL COMBUSTION ENGINE, which is assigned to the assignee of the present invention, and the disclosure of which is incorporated herein by reference. Those skilled in the art will recognize that other known intake air pressure estimation algorithms may alternatively be used to supply the intake air pressure information at step 102.

Following step 102, algorithm execution advances to step 104 where control computer is operable to determine a turbocharger control command, TCC, wherein TCC corresponds to a position command for any one or more of the VGT actuator 66, exhaust throttle actuator 72 and/or wastegate valve actuator 80. In one embodiment, for example, TCC may be the commanded VGT position, VGTC. In an alternate embodiment, TCC may be the commanded exhaust throttle position, EXTC, and in yet another embodiment, TCC may be the commanded wastegate position, WGC. In a further embodiment, TCC may include any combination of the foregoing position commands. It is to be understood that any of the VGT actuator 66, exhaust throttle actuator 72 and/or wastegate valve actuator 80 may include a position sensor operable to sense a position of a corresponding actuator relative to a reference position and provide a corresponding position signal to control computer 42. In such embodiments, the one or combination of position commands used to generate TCC may be replaced by any one or combination of position signals produced by such actuator position sensors, and the turbocharger control command, TCC, in such embodiments is defined by any single one, or combination, of such position signals.

From step 104, algorithm execution advances to step 106 where control computer 42 is operable to input a number of model constants, MC. In one embodiment, the model and model constants are stored in memory 45, and control computer 42 is operable to execute step 106 by recalling the exhaust pressure model and model constants, MC, from memory 45.

Following step 106, algorithm execution advances to step 108 where control computer 42 is operable to estimate engine exhaust pressure, $EP_E$; i.e., the pressure of exhaust gas within exhaust conduit 32 and exhaust manifold 30, as a function of IAP, TCC and the model constants, MC. In one embodiment, $EP_E$ is estimated according to the model:

$$EP_E=(A*IAP+B)*(C*TCC+D),$$

where,

IAP is the intake air pressure value,

TCC is the turbocharger control command, and corresponds to any single one, or combination of, the VGTC, EXTC and WGC commands produced by control computer 42 on signal paths 68, 74 and 82, respectively (or single one, or combination of, VGT, EST and WGG position signals provided by corresponding actuator position sensors), and A, B, C and D are model constants.

In one specific implementation of the present invention, A=0.915418, B=4.603, C=0.003203687 and D=0.87738687, and TCC corresponds to the VGTC command and may take on any value between 0 and 100. It is to be understood, however, that other values of the model constants are contemplated, and TCC may alternatively correspond to the EXTC command, the WGC command, or any combination of the VGTC, EXTC and WGC commands, or any single one, or combination, of actuator position signals corresponding thereto. IAP and $EP_E$ are, in one embodiment, represented in units of PSIA, although other units of IAP and $EP_E$ are contemplated.

In accordance with another aspect of the present invention, intake air pressure, IAP, may alternatively or additionally be estimated as a function of the engine exhaust pressure signal, EP, provided by exhaust pressure sensor 46 and one or more of the turbocharger swallowing capacity/efficiency control mechanism commands; e.g., VGTP, EXTP and/or WGP. Such an estimation may be useful, by itself, in providing intake air information to one or more control algorithms executed by control computer 42 and/or other processor in communication therewith. Such an estimation may alternatively or additionally be useful in providing redundant and/or backup intake air pressure information. Such an estimation may further be useful in diagnosing fault and/or failure conditions related to the intake air pressure sensor 50 and/or ΔP sensor 54, and/or used in systems wherein the ΔP information is unreliable or unavailable.

Figure 3:
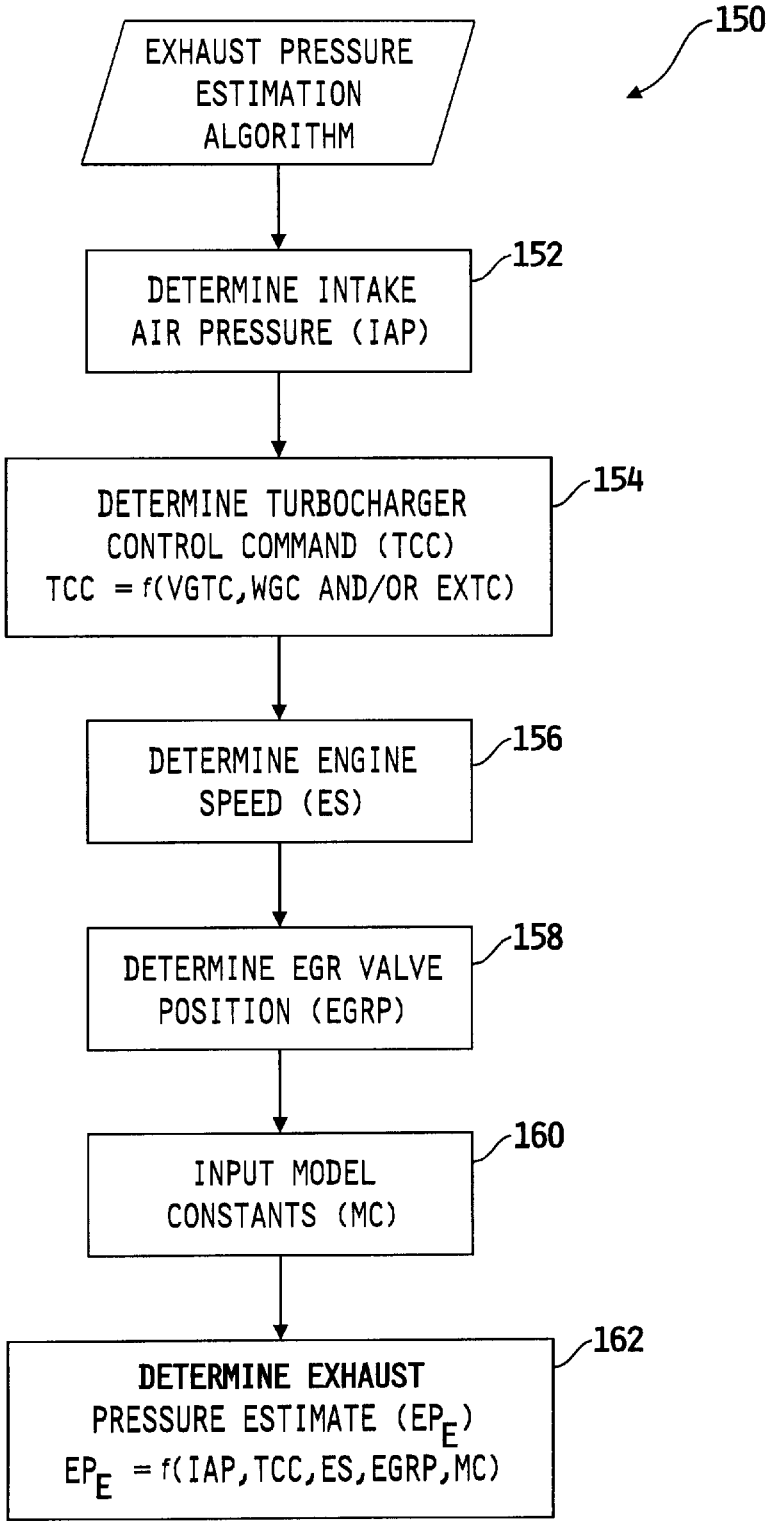
FIG. 3 is a flowchart illustrating an alternate embodiment of a software algorithm for estimating engine exhaust pressure, in accordance with the present invention.

Referring now to FIG. 3, a flowchart is shown illustrating an alternate embodiment of a software algorithm 150 for estimating engine exhaust pressure, in accordance with the present invention. Algorithm 150 is preferably stored within memory 45, and is executed by control computer 42. Algorithm 150 begins at step 152 where control computer 42 is operable to determine intake air pressure, IAP, corresponding to the pressure of air within the intake conduit 20 and intake manifold 14. In one embodiment, control computer 42 is operable to determine IAP directly from sensor 50, although the present invention contemplates that control computer 42 may alternatively or additionally include one or more known software algorithms for estimating IAP as a function of one or more engine operating conditions other than engine exhaust pressure. An example of one such intake air pressure estimation algorithm is described in co-pending U.S. Patent Application Publication No. US2003/0177765 A1, entitled SYSTEM FOR ESTIMATING ABSOLUTE BOOST PRESSURE IN A TURBOCHARGED INTERNAL COMBUSTION ENGINE, which is assigned to the assignee of the present invention, and the disclosure of which was incorporated herein by reference. Those skilled in the art will recognize that other known intake air pressure estimation algorithms may alternatively be used to supply the intake air pressure information at step 152.

Following step 152, algorithm execution advances to step 154 where control computer is operable to determine a turbocharger control command, TCC, wherein TCC corresponds to a position command for any one or more of the VGT actuator 66, exhaust throttle actuator 72 and/or wastegate valve actuator 80. In one embodiment, for example, TCC may be the commanded VGT position, VGTC. In an alternate embodiment, TCC may be the commanded exhaust throttle position, EXTC, and in yet another embodiment, TCC may be the commanded wastegate position, WGC. In a further embodiment, TCC may include any combination of the foregoing position commands. It is to be understood that any of the VGT actuator 66, exhaust throttle actuator 72 and/or wastegate valve actuator 80 may include a position sensor operable to sense a position of a corresponding actuator relative to a reference position and provide a corresponding position signal to control computer 42. In such embodiments, the one or combination of position commands used to generate TCC may be replaced by any one or combination of position signals produced by such actuator position sensors, and the turbocharger control command, TCC, in such embodiments is defined by any single one, or combination, of such position signals.

From step 154, algorithm execution advances to step 156 where control computer 42 is operable to determine engine speed, ES, corresponding to the rotational speed of engine 12. In one embodiment, control computer 42 is operable to determine engine speed, ES, directly from the engine speed sensor 44. Alternatively, control computer 42 may be operable at step 156 to determine the engine speed value, ES, in accordance with any known technique.

From step 156, algorithm execution advances to step 158 where control computer 42 is operable to determine EGR valve position, EGRP, corresponding to the position of EGR valve 36 relative to a reference position. In one embodiment, control computer 42 is operable to determine the EGR valve position, EGRP, directly from the EGR valve position sensor 64. Alternatively, control computer 42 may be operable at step 158 to determine the EGR valve position value, EGRP, in accordance with any known technique.

Following step 158, algorithm execution advances to step 160 where control computer 42 is operable to input a number of model constants, MC. In one embodiment, the model and model constants are stored in memory 45, and control computer 42 is operable to execute step 160 by recalling the exhaust pressure model and model constants, MC, from memory 45.

Following step 160, algorithm execution advances to step 162 where control computer 42 is operable to estimate engine exhaust pressure, $EP_E$; i.e., the pressure of exhaust gas within exhaust conduit 32 and exhaust manifold 30, as a function of IAP, TCC, ES, EGRP and the model constants, MC. In one embodiment, $EP_E$ is estimated according to the model:

$$EP_E=A+B*IAP+C*TCC+D*ES+E*EGRP,$$

where,

IAP is the intake air pressure value,

TCC is the turbocharger control command, and corresponds to any single one, or combination of, the VGTC, EXTC and WGC commands produced by control computer 42 on signal paths 68, 74 and 82, respectively (or single one, or combination of, VGT, EST and WGG position signals provided by corresponding actuator position sensors), ES is the engine speed value, EGRP is the EGR valve position value, and A, B, C, D and E are model constants.

In one specific implementation of the present invention, A=−10.7207, B=0.9980, C=0.1685, D=0.0054 and E=−0.5593, and TCC corresponds to the VGTC command and may take on any value between 0 and 100. It is to be understood, however, that other values of the model constants are contemplated, and TCC may alternatively correspond to the EXTC command, the WGC command, or any combination of the VGTC, EXTC and WGC commands, or any single one, or combination, of actuator position signals corresponding thereto. IAP and $EP_E$ are, in one embodiment, represented in units of PSIA, although other units of IAP and $EP_E$ are contemplated.

In accordance with another aspect of the present invention, intake air pressure, IAP, may alternatively or additionally be estimated in one embodiment as a function of the engine exhaust pressure signal, EP, provided by exhaust pressure sensor 46 and one or more of the turbocharger swallowing capacity/efficiency control mechanism commands; e.g., VGTC, EXTC and/or WGC. In an alternative embodiment, IAP, may be estimated as a function of the engine exhaust pressure signal, EP, provided by exhaust pressure sensor 46, one or more of the turbocharger swallowing capacity/efficiency control mechanism commands; e.g., VGTC, EXTC and/or WGC, the engine speed signal, ES, provided by engine speed sensor 44 and the EGR valve position signal, EGRP, provided by position sensor 64. In either case, such an estimation may be useful, by itself, in providing intake air information to one or more control algorithms executed by control computer 42 and/or other processor in communication therewith. Such an estimation may alternatively or additionally be useful in providing redundant and/or backup intake air pressure information. Such an estimation may further be useful in diagnosing fault and/or failure conditions related to the intake air pressure sensor 50 and/or ΔP sensor 54, and/or used in systems wherein the ΔP information is unreliable or unavailable.

Figure 4:
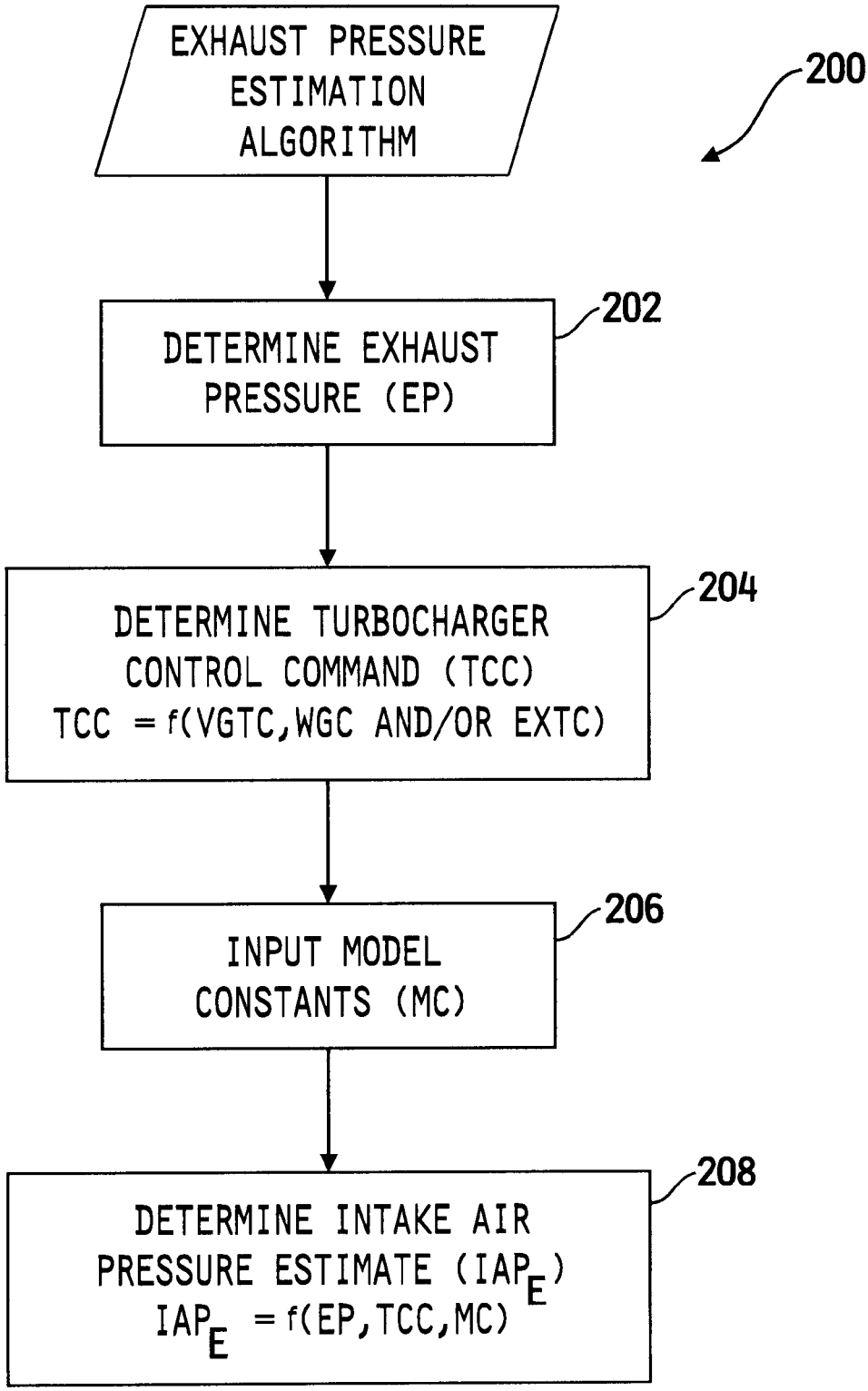
FIG. 4 is a flowchart illustrating one preferred embodiment of a software algorithm for estimating intake air pressure, in accordance with the present invention.

Referring now to FIG. 4, a flowchart is shown illustrating one preferred embodiment of a software algorithm 200 for estimating intake air pressure, in accordance with the present invention. Algorithm 200 is preferably stored within memory 45, and is executed by control computer 42. Algorithm 200 begins at step 202 where control computer 42 is operable to determine engine exhaust pressure, EP, corresponding to the pressure of engine exhaust within the exhaust manifold 30 and exhaust conduit 32. In one embodiment, control computer 42 is operable to determine EP directly from sensor 50, although the present invention contemplates that control computer 42 may alternatively or additionally include one or more known software algorithms for estimating EP as a function of one or more engine operating conditions other than intake air pressure.

Following step 202, algorithm execution advances to step 204 where control computer is operable to determine a turbocharger control command, TCC, wherein TCC corresponds to a position command for any one or more of the VGT actuator 66, exhaust throttle actuator 72 and/or wastegate valve actuator 80. In one embodiment, for example, TCC may be the commanded VGT position, VGTC. In an alternate embodiment, TCC may be the commanded exhaust throttle position, EXTC, and in yet another embodiment, TCC may be the commanded wastegate position, WGC. In a further embodiment, TCC may include any combination of the foregoing position commands. It is to be understood that any of the VGT actuator 66, exhaust throttle actuator 72 and/or wastegate valve actuator 80 may include a position sensor operable to sense a position of a corresponding actuator relative to a reference position and provide a corresponding position signal to control computer 42. In such embodiments, the one or combination of position commands used to generate TCC may be replaced by any one or combination of position signals produced by such actuator position sensors, and the turbocharger control command, TCC, in such embodiments is defined by any single one, or combination, of such position signals.

From step 204, algorithm execution advances to step 206 where control computer 42 is operable to input a number of model constants, MC. In one embodiment, the model and model constants are stored in memory 45, and control computer 42 is operable to execute step 206 by recalling the intake air pressure model and model constants, MC, from memory 45.

Following step 206, algorithm execution advances to step 208 where control computer 42 is operable to estimate intake air pressure, $IAP_E$; i.e., the pressure of air within intake manifold 14 and intake conduit 20, as a function of EP, TCC and the model constants, MC. In one embodiment, $IAP_E$ is estimated according to the model:

$$IAP_E=\{[EP/(C*TCC+D)]-B\}/A,$$

where,

EP is the engine exhaust pressure value,

TCC is the turbocharger control command, and corresponds to any single one, or combination of, the VGTC, EXTC and WGC commands produced by control computer 42 on signal paths 68, 74 and 82, respectively (or single one, or combination of, VGT, EST and WGG position signals provided by corresponding actuator position sensors), and A, B, C and D are model constants.

In one specific implementation of the present invention, A=0.915418, B=4.603, C=0.003203687 and D=0.87738687, and TCC corresponds to the VGTC command and may take on any value between 0 and 100. It is to be understood, however, that other values of the model constants are contemplated, and TCC may alternatively correspond to the EXTC command, the WGC command, or any combination of the VGTC, EXTC and WGC commands, or any one, or combination, of actuator position signals corresponding thereto. EP and $IAP_E$ are, in one embodiment, represented in units of PSIA, although other units of EP and $IAP_E$ are contemplated.

Figure 5:
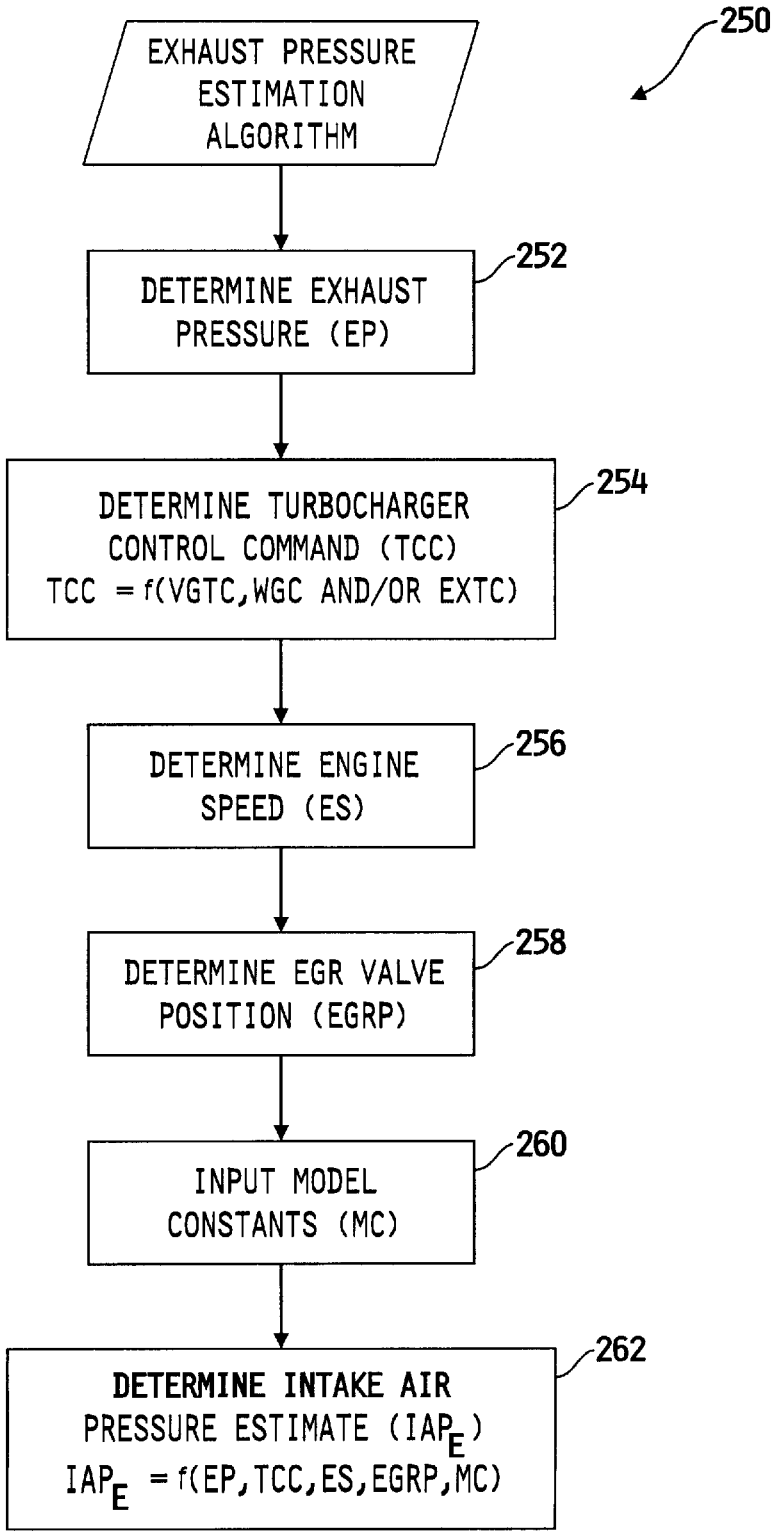
FIG. 5 is a flowchart illustrating an alternate embodiment of a software algorithm for estimating intake air pressure, in accordance with the present invention.

Referring now to FIG. 5, a flowchart is shown illustrating an alternate embodiment of a software algorithm 250 for estimating intake air pressure, in accordance with the present invention. Algorithm 250 is preferably stored within memory 45, and is executed by control computer 42. Algorithm 250 begins at step 252 where control computer 42 is operable to determine engine exhaust pressure, EP, corresponding to the pressure of engine exhaust within the exhaust manifold 30 and exhaust conduit 32. In one embodiment, control computer 42 is operable to determine EP directly from sensor 50, although the present invention contemplates that control computer 42 may alternatively or additionally include one or more known software algorithms for estimating EP as a function of one or more engine operating conditions other than intake air pressure.

Following step 252, algorithm execution advances to step 254 where control computer is operable to determine a turbocharger control command, TCC, wherein TCC corresponds to a position command for any one or more of the VGT actuator 66, exhaust throttle actuator 72 and/or wastegate valve actuator 80. In one embodiment, for example, TCC may be the commanded VGT position, VGTC. In an alternate embodiment, TCC may be the commanded exhaust throttle position, EXTC, and in yet another embodiment, TCC may be the commanded wastegate position, WGC. In a further embodiment, TCC may include any combination of the foregoing position commands. It is to be understood that any of the VGT actuator 66, exhaust throttle actuator 72 and/or wastegate valve actuator 80 may include a position sensor operable to sense a position of a corresponding actuator relative to a reference position and provide a corresponding position signal to control computer 42. In such embodiments, the one or combination of position commands used to generate TCC may be replaced by any one or combination of position signals produced by such actuator position sensors, and the turbocharger control command, TCC, in such embodiments is defined by any single one, or combination, of such position signals.

From step 254, algorithm execution advances to step 256 where control computer 42 is operable to determine engine speed, ES, corresponding to the rotational speed of engine 12. In one embodiment, control computer 42 is operable to determine engine speed, ES, directly from the engine speed sensor 44. Alternatively, control computer 42 may be operable at step 156 to determine the engine speed value, ES, in accordance with any known technique.

From step 256, algorithm execution advances to step 258 where control computer 42 is operable to determine EGR valve position, EGRP, corresponding to the position of EGR valve 36 relative to a reference position. In one embodiment, control computer 42 is operable to determine the EGR valve position, EGRP, directly from the EGR valve position sensor 64. Alternatively, control computer 42 may be operable at step 158 to determine the EGR valve position value, EGRP, in accordance with any known technique.

Following step 258, algorithm execution advances to step 260 where control computer 42 is operable to input a number of model constants, MC. In one embodiment, the model and model constants are stored in memory 45, and control computer 42 is operable to execute step 260 by recalling the intake air pressure model and model constants, MC, from memory 45.

Following step 260, algorithm execution advances to step 262 where control computer 42 is operable to estimate intake air pressure, $IAP_E$; i.e., the pressure of air within intake manifold 14 and intake conduit 20, as a function of EP, TCC, ES, EGRP and the model constants, MC. In one embodiment, $IAP_E$ is estimated according to the model:

$$IAP_E=(EP-A-C*TCC-D*ES-E*EGRP)/B,$$

where,

EP is the engine exhaust pressure value,

TCC is the turbocharger control command, and corresponds to any single one, or combination of, the VGTC, EXTC and WGC commands produced by control computer 42 on signal paths 68, 74 and 82, respectively (or single one, or combination of, VGT, EST and WGG position signals provided by corresponding actuator position sensors), ES is the engine speed value, EGRP is the EGR valve position value, and A, B, C, D and E are model constants.

In one specific implementation of the present invention, A=−10.7207, B=0.9980, C=0.1685, D=0.0054 and E=−0.5593, and TCC corresponds to the VGTC command and may take on any value between 0 and 100. It is to be understood, however, that other values of the model constants are contemplated, and TCC may alternatively correspond to the EXTC command, the WGC command, or any combination of the VGTC, EXTC and WGC commands, or any single one, or combination, of actuator position signals corresponding thereto. $IAP_E$ and EP are, in one embodiment, represented in units of PSIA, although other units of $IAP_E$ and EP are, in one embodiment, represented in units of PSIA, although other units of EP and IAPE are contemplated.

While the invention has been illustrated and described in detail in the foregoing drawings and description, the same is to be considered as illustrative and not restrictive in character, it being understood that only preferred embodiments thereof have been shown and described and that all changes and modifications that come within the spirit of the invention are desired to be protected.

What is claimed is:

1. System for estimating engine exhaust pressure, comprising:

a turbocharger having a compressor fluidly coupled to an intake manifold of the engine via a first conduit, and a turbine fluidly coupled to an exhaust manifold of the engine via a second conduit;

means for determining intake air pressure within said first conduit;

means responsive to a turbocharger control command for controlling either of a swallowing capacity and a swallowing efficiency of said turbine; and a control computer estimating engine exhaust pressure within said second conduit as a function of said intake air pressure and said turbocharger control command.

2. The system of claim 1 further including a memory having said function stored therein.

3. The system of claim 2 wherein said function is an engine exhaust pressure model of the form:

$$EP_E=(A*IAP+B)*(C*TCC+D)$$

wherein $EP_E$ is said engine exhaust pressure estimate, IAP is said intake air pressure, TCC is said turbocharger control command, and A, B, C and D are each constants.

4. The system of claim 1 wherein said means responsive to a turbocharger control command for controlling either of a swallowing capacity and a swallowing efficiency of said turbine includes:

means for varying a flow geometry of said turbine; and an actuator responsive to said turbocharger control command to control said means for varying a flow geometry of said turbine, said control computer controlling said swallowing capacity of said turbine via said turbocharger control command.

5. The system of claim 1 wherein said means responsive to a turbocharger control command for controlling either of a swallowing capacity and a swallowing efficiency of said turbine includes:

an exhaust throttle receiving therethrough exhaust gas supplied by said exhaust manifold to said turbine; and an actuator responsive to said turbocharger control command to control exhaust gas flow through said exhaust throttle, said control computer controlling said swallowing capacity of said turbine via said turbocharger control command.

6. The system of claim 1 wherein said means responsive to a turbocharger control command for controlling either of a swallowing capacity and a swallowing efficiency of said turbine includes:

a wastegate valve having an inlet fluidly coupled to said second conduit and an outlet fluidly coupled to ambient; and an actuator responsive to said turbocharger control command to control said wastegate valve to selectively divert engine exhaust away from said turbine, said control computer controlling said swallowing efficiency of said turbine via said turbocharger control command.

7. The system of claim 1 further including:

an engine speed sensor producing an engine speed signal indicative of engine rotational speed;

an EGR valve fluidly connected at one end to said first conduit and at an opposite end to said second conduit, said EGR valve configured to control a flow of recirculated exhaust gas from said exhaust manifold to said intake manifold; and a position sensor producing a position signal indicative of a position of said EGR valve relative to a reference position;

and wherein said control computer is operable to estimate said engine exhaust pressure further as a function of said engine speed signal and said position signal.

8. The system of claim 7 further including a memory having said function stored therein.

9. The system of claim 8 wherein said function is an engine exhaust pressure model of the form:

$$EP_E=A+B*IAP+C*TCC+D*ES+E*EGRP$$

wherein $EP_E$ is said engine exhaust pressure estimate, IAP is said intake air pressure, TCC is said turbocharger control command, ES is said engine speed signal, EGRP is said position signal, and A, B, C, D and E are each constants.

10. The system of claim 7 wherein said means responsive to a turbocharger control command for controlling either of a swallowing capacity and a swallowing efficiency of said turbine includes:

means for varying a flow geometry of said turbine; and an actuator responsive to said turbocharger control command to control said means for varying a flow geometry of said turbine, said control computer controlling said swallowing capacity of said turbine via said turbocharger control command.

11. The system of claim 7 wherein said means responsive to a turbocharger control command for controlling either of a swallowing capacity and a swallowing efficiency of said turbine includes:

an exhaust throttle receiving therethrough exhaust gas supplied by said exhaust manifold to said turbine; and an actuator responsive to said turbocharger control command to control exhaust gas flow through said exhaust throttle, said control computer controlling said swallowing capacity of said turbine via said turbocharger control command.

12. The system of claim 7 wherein said means responsive to a turbocharger control command for controlling either of a swallowing capacity and a swallowing efficiency of said turbine includes:

a wastegate valve having an inlet fluidly coupled to said second conduit and an outlet fluidly coupled to ambient; and an actuator responsive to said turbocharger control command to control said wastegate valve to selectively divert engine exhaust away from said turbine, said control computer controlling said swallowing efficiency of said turbine via said turbocharger control command.

13. A method of estimating engine exhaust pressure, comprising the steps of:

determining an intake air pressure corresponding to pressure of air supplied by a turbocharger compressor to an intake manifold of the engine;

determining a turbocharger control command corresponding to a command for controlling either of a swallowing capacity and a swallowing efficiency of a turbocharger turbine coupled to said compressor; and estimating engine exhaust pressure as a function of said intake air pressure and said turbocharger control command.

14. The method of claim 13 wherein said function is an engine exhaust pressure model of the form:

$$EP_E=(A*IAP+B)*(C*TCC+D)$$

wherein $EP_E$ is said engine exhaust pressure estimate, IAP is said intake air pressure, TCC is said turbocharger control command, and A, B, C and D are each constants.

15. The method of claim 13 wherein a variable geometry turbocharger actuator is responsive to said turbocharger control command to control said swallowing capacity of said turbine by controlling a flow geometry of said turbine.

16. The method of claim 13 wherein an exhaust throttle actuator is responsive to said turbocharger control command to control said swallowing capacity of said turbine by controlling a flow rate of engine exhaust through said turbine.

17. The method of claim 13 wherein a wastegate valve actuator is responsive to said turbocharger control command to control said swallowing efficiency of said turbine by controllably diverting engine exhaust away from said turbine.

18. The method of claim 13 further including the steps of:

determining an engine speed corresponding to rotational speed of the engine; and determining an EGR valve position corresponding to a position of an EGR valve, fluidly coupled between the intake manifold and an exhaust manifold of the engine, relative to a reference position;

and wherein the estimating step includes estimating said engine exhaust pressure further as a function of said engine speed and said EGR valve position.

19. The method of claim 18 wherein said function is an engine exhaust pressure model of the form:

$$EP_E=A+B*IAP+C*TCC+D*ES+E*EGRP$$

wherein $EP_E$ is said engine exhaust pressure estimate, IAP is said intake air pressure, TCC is said turbocharger control command, ES is said engine speed, EGRP is said EGR valve position, and A, B, C, D and E are each constants.

20. The method of claim 18 wherein a variable geometry turbocharger actuator is responsive to said turbocharger control command to control said swallowing capacity of said turbine by controlling a flow geometry of said turbine.

21. The method of claim 18 wherein an exhaust throttle actuator is responsive to said turbocharger control command to control said swallowing capacity of said turbine by controlling a flow rate of engine exhaust through said turbine.

22. The method of claim 18 wherein a wastegate valve actuator is responsive to said turbocharger control command to control said swallowing efficiency of said turbine by controllably diverting engine exhaust away from said turbine.

23. System for estimating engine exhaust pressure, comprising:

a turbocharger having a compressor fluidly coupled to an intake manifold of the engine via a first conduit, and a turbine fluidly coupled to an exhaust manifold of the engine via a second conduit;

a pressure sensor producing a pressure signal indicative of air pressure within said first conduit;

a variable geometry turbocharger actuator responsive to a control command to control a flow geometry of said turbine; and a control computer estimating engine exhaust pressure within said second conduit as a function of said pressure signal and said control command.

24. The system of claim 23 further including a memory having said function stored therein.

25. The system of claim 24 wherein said function is an engine exhaust pressure model of the form:

$$EP_E=(A*P+B)*(C*CC+D)$$

wherein $EP_E$ is said engine exhaust pressure estimate, P is said pressure signal, CC is said control command, and A, B, C and D are each constants.

26. The system of claim 23 further including:

an engine speed sensor producing an engine speed signal indicative of engine rotational speed;

an EGR valve fluidly connected at one end to said first conduit and at an opposite end to said second conduit, said EGR valve configured to control a flow of recirculated exhaust gas from said exhaust manifold to said intake manifold; and a position sensor producing a position signal indicative of a position of said EGR valve relative to a reference position;

and wherein said control computer is operable to estimate said engine exhaust pressure further as a function of said engine speed signal and said position signal.

27. The system of claim 26 further including a memory having said function stored therein.

28. The system of claim 27 wherein said function is an engine exhaust pressure model of the form:

$$EP_E=A+B*P+C*CC+D*ES+E*EGRP$$

wherein $EP_E$ is said engine exhaust pressure estimate, P is said pressure signal, CC is said control command, ES is said engine speed signal, EGRP is said position signal, and A, B, C, D and E are each constants.

29. System for estimating engine exhaust pressure, comprising:

a turbocharger having a compressor fluidly coupled to an intake manifold of the engine via a first conduit, and a turbine fluidly coupled to an exhaust manifold of the engine via a second conduit;

a pressure sensor producing a pressure signal indicative of air pressure within said first conduit;

an exhaust throttle receiving engine exhaust therethrough;

an actuator responsive to a control command to control a flow rate of engine exhaust through said exhaust throttle and thereby through said turbine; and a control computer estimating engine exhaust pressure within said second conduit as a function of said pressure signal and said control command.

30. The system of claim 29 further including a memory having said function stored therein.

31. The system of claim 30 wherein said function is an engine exhaust pressure model of the form:

$$EP_E=(A*P+B)*(C*CC+D)$$

wherein $EP_E$ is said engine exhaust pressure estimate, P is said pressure signal, CC is said control command, and A, B, C and D are each constants.

32. The system of claim 29 further including:

an engine speed sensor producing an engine speed signal indicative of engine rotational speed;

an EGR valve fluidly connected at one end to said first conduit and at an opposite end to said second conduit, said EGR valve configured to control a flow of recirculated exhaust gas from said exhaust manifold to said intake manifold; and a position sensor producing a position signal indicative of a position of said EGR valve relative to a reference position;

and wherein said control computer is operable to estimate said engine exhaust pressure further as a function of said engine speed signal and said position signal.

33. The system of claim 32 further including a memory having said function stored therein.

34. The system of claim 33 wherein said function is an engine exhaust pressure model of the form:

$$EP_E=A+B*P+C*CC+D*ES+E*EGRP$$

wherein $EP_E$ is said engine exhaust pressure estimate, P is said pressure signal, CC is said control command, ES is said engine speed signal, EGRP is said position signal, and A, B, C, D and E are each constants.

35. System for estimating engine exhaust pressure, comprising:

a turbocharger having a compressor fluidly coupled to an intake manifold of the engine via a first conduit, and a turbine fluidly coupled to an exhaust manifold of the engine via a second conduit;

a pressure sensor producing a pressure signal indicative of air pressure within said first conduit;

a wastegate valve having an inlet fluidly coupled to said second conduit and an outlet fluidly coupled to ambient;

an actuator responsive to a control command control said wastegate to selectively divert engine exhaust away from said turbine; and a control computer estimating engine exhaust pressure within said second conduit as a function of said pressure signal and said control command.

36. The system of claim 35 further including a memory having said function stored therein.

37. The system of claim 36 wherein said function is an engine exhaust pressure model of the form:

$$EP_E=(A*P+B)*(C*CC+D)$$

wherein $EP_E$ is said engine exhaust pressure estimate, P is said pressure signal, CC is said control command, and A, B, C and D are each constants.

38. The system of claim 35 further including:

an engine speed sensor producing an engine speed signal indicative of engine rotational speed;

an EGR valve fluidly connected at one end to said first conduit and at an opposite end to said second conduit, said EGR valve configured to control a flow of recirculated exhaust gas from said exhaust manifold to said intake manifold; and a position sensor producing a position signal indicative of a position of said EGR valve relative to a reference position;

and wherein said control computer is operable to estimate said engine exhaust pressure further as a function of said engine speed signal and said position signal.

39. The system of claim 38 further including a memory having said function stored therein.

40. The system of claim 39 wherein said function is an engine exhaust pressure model of the form:

$$EP_E = A + B*P + C*CC + D*ES + E*EGRP$$

wherein $EP_E$ is said engine exhaust pressure estimate, P is said pressure signal, CC is said control command, ES is said engine speed signal, EGRP is said position signal, and A, B, C, D and E are each constants.

* * * * *